US007284814B2

(12) United States Patent
Ogasawara

(10) Patent No.: US 7,284,814 B2
(45) Date of Patent: Oct. 23, 2007

(54) INK JET PRINTING APPARATUS AND PRINTING CONTROL METHOD

(75) Inventor: Seiji Ogasawara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/782,781

(22) Filed: Feb. 23, 2004

(65) Prior Publication Data

US 2005/0024417 A1 Feb. 3, 2005

(30) Foreign Application Priority Data

Feb. 26, 2003 (JP) ..... 2003-050121

(51) Int. Cl.
*B41J 29/393* (2006.01)

(52) U.S. Cl. ..... 347/19

(58) Field of Classification Search ..... 347/19, 347/16

See application file for complete search history.

(56) References Cited

U.S. PATENT DOCUMENTS 6,527,360 B2 * 3/2003 Otsuki et al. ..... 347/19
6,604,806 B1 * 8/2003 Yamada et al. ..... 347/15
2002/0063871 A1 * 5/2002 Kinas ..... 358/1.4
2002/0105558 A1 * 8/2002 Otsuki ..... 347/19
2002/0196298 A1 * 12/2002 Cheng et al. ..... 347/9
2004/0207674 A1 * 10/2004 Otsuki ..... 347/19

* cited by examiner

*Primary Examiner*—Stephen Meier
*Assistant Examiner*—Jason Uhlenhake
(74) *Attorney, Agent, or Firm*—Fitzpatrick, Cella, Harper & Scinto

(57) ABSTRACT

An ink jet printing apparatus, which enables high-grade printing to be carried out all over a print medium, includes a print medium conveying section for conveying a print medium, a scanning section for moving a print head that ejects ink droplets along a main scanning direction crossing a direction in which the print medium is conveyed, and a printing control section for controlling an operation performed by the print head to eject droplets. On the basis of a plurality of landing position adjustment values set in association with a plurality of areas in the conveying direction of the print medium, the printing control section controls the operation of ejecting ink droplets in each area.

3 Claims, 9 Drawing Sheets

FORWARD SCAN PRINTING

BACKWARD SCAN PRINTING

TEST PRINTING

INK JET PRINTING APPARATUS AND PRINTING CONTROL METHOD

This application claims priority from Japanese Patent Application No. 2003-050121 filed Feb. 26, 2003, which is incorporated hereinto by reference.

BACKGROUND OF THE INVENTION

1. Field of the Invention

The present invention relates to an ink jet printing apparatus that prints a print medium by moving a print head ejecting ink, in a direction crossing a direction in which the print medium is conveyed, and in particular, to an ink jet printing apparatus that can adjust deviation of landing positions of ink droplets if a printing operation is performed by reciprocating the print head, as well as a printing control method for the ink jet printing apparatus.

2. Description of the Related Art

In the prior art, serial printer type ink jet printing apparatuses perform a printing operation while moving a print head in a direction crossing a direction in which the print medium is conveyed. With such an inkjet printing apparatus, a position at which ink lands on a print medium may vary between a forward scan and a backward scan of the print head during a printing operation. To solve this problem, what is called registration is carried out to, for example, adjust ejection timing.

Ink jet printing apparatuses having such a registration function are widely applied to PC printers, facsimile machines, multifunction printers, and the like.

Description will be given of an example of registration conventionally carried out in ink jet printing apparatuses capable of bidirectional printing.

First, data required to print the test patterns shown in FIG. 7C is divided. The test pattern shown in FIG. 7A is printed during forward printing. The test pattern shown in FIG. 7B is printed during backward printing. In both cases, the patterns are formed in the same area. Then, the print medium is conveyed by a predetermined amount, and similar test patterns are printed in an area that has not been printed yet. This process is repeated a number of times. However, for each printing area, timing for ink ejection is varied during at least one of forward scan printing and backward scan printing. This provides output results such as those shown in FIGS. 8A to 8E. Then, one of these results is selected which is most similar to the test pattern shown in FIG. 7C. Specifically, the pattern shown in FIG. 8C is selected to determine ink ejection timing for the smallest variation in ink droplet landing positions between forward printing and backward printing. That is, a registration value is determined. If a plurality of print element arrays are formed in the print head, each print element array is registered.

To accurately and stably achieve registration such as that described above, it is necessary to print the test patterns so as to maintain a fixed distance between a print element arranged surface of a print head 13 and a sheet surface (this distance will hereinafter referred to as a "sheet distance") Thus, in the prior art, the test patterns are printed by sandwiching the sheet between a conveying roller 8 and a pinch roller 12 and pressing these rollers against the top surface of a platen 6.

Registration values thus obtained are used from the start to end of a printing operation as shown at step S20 in the flow chart shown in FIG. 9.

On the other hand, ink jet printing apparatuses have recently commonly been used as equipment that outputs images photographed using a digital camera. The outputted images are desired to achieve photograph-like high-grade printing all over print media as in the case of marginless printing (hereinafter referred to as a "full bleed printing").

However, with the prior art registration, after the trailing edge (hereinafter referred to as a "back end of sheet") of a print medium has passed through the conveying roller, an urging force exerted on the print medium decreases significantly. Thus, the sheet distance changes from the one obtained by the registration to shift the landing positions of ink droplets (misregistration) As a result, after the trailing edge of the print medium has passed through the conveying roller, the printed image is significantly degraded compared to the image obtained before the passage of the trailing end.

SUMMARY OF THE INVENTION

The present invention is provided to solve the problems of the prior art. It is an object of the present invention to provide an ink jet printing apparatus which is capable of bidirectional printing and which enables high-grade printing to be carried out all over a print medium.

To accomplish this object, the present invention is configured as described below.

The first aspect of the present invention provides an ink jet printing apparatus comprising print medium conveying means for conveying a print medium, scanning means for moving a print head that ejects ink droplets, along a main scanning direction crossing a direction in which the print medium is conveyed, and printing control means for controlling an operation performed by the print head to eject droplets, wherein the printing control means comprises first printing control means for allowing formation of test patterns used to adjust landing positions of ink droplets in the main scanning direction, the ink droplet ejected by the print head onto the print medium, and second printing control means for controlling the operation performed by the print head to eject ink droplets in the main scanning direction on the basis of landing position adjustment values for the ink droplets determined on the basis of the test patterns, and wherein on the basis of a plurality of landing position adjustment values set in association with a plurality of areas in the conveying direction of the print medium, the second printing control means controls the operation of ejecting ink droplets from the print head in each area.

The second aspect of the present invention provides an ink jet printing apparatus comprising conveying means for conveying printing medium along a conveying direction, scanning means for reciprocally moving a print head that ejects ink droplets along a main direction crossing the conveying direction, printing control means for controlling an operation performed by the print head to eject droplets while the printing head is reciprocally moved by the scanning means, the apparatus comprising: registration means for adjusting an ink ejecting timing from printing head in forward scanning and backward scanning according to an adjusting value, control means for controlling the registration means so as to adjust the ink ejecting timing using the adjustment value corresponding to the position of the printing medium conveyed by the conveying means in the conveying direction; wherein the control means controls the registration means so that the adjustment value is used to adjust the ink ejecting timing out of a plurality of adjustment values corresponding to the positions of the printing medium in the conveying direction.

According to the present invention, on the basis of the plurality of landing position adjustment values set corresponding to the plurality of areas in the conveying direction of the medium, the operation of ejecting ink droplets from the print head in each area is controlled. Consequently, high-grade printing can be achieved all over the print medium. Thus, by applying the ink jet printing apparatus according to the present invention to an apparatus that outputs images photographed using a digital camera or the like, it is possible to obtain high-grade images even in full bleed printing that prints the whole area of a print medium.

The above and other objects, effects, features and advantages of the present invention will become more apparent from the following description of embodiments thereof taken in conjunction with the accompanying drawings.

DETAILED DESCRIPTION OF PREFERRED EMBODIMENTS

First Embodiment

Figure 1:
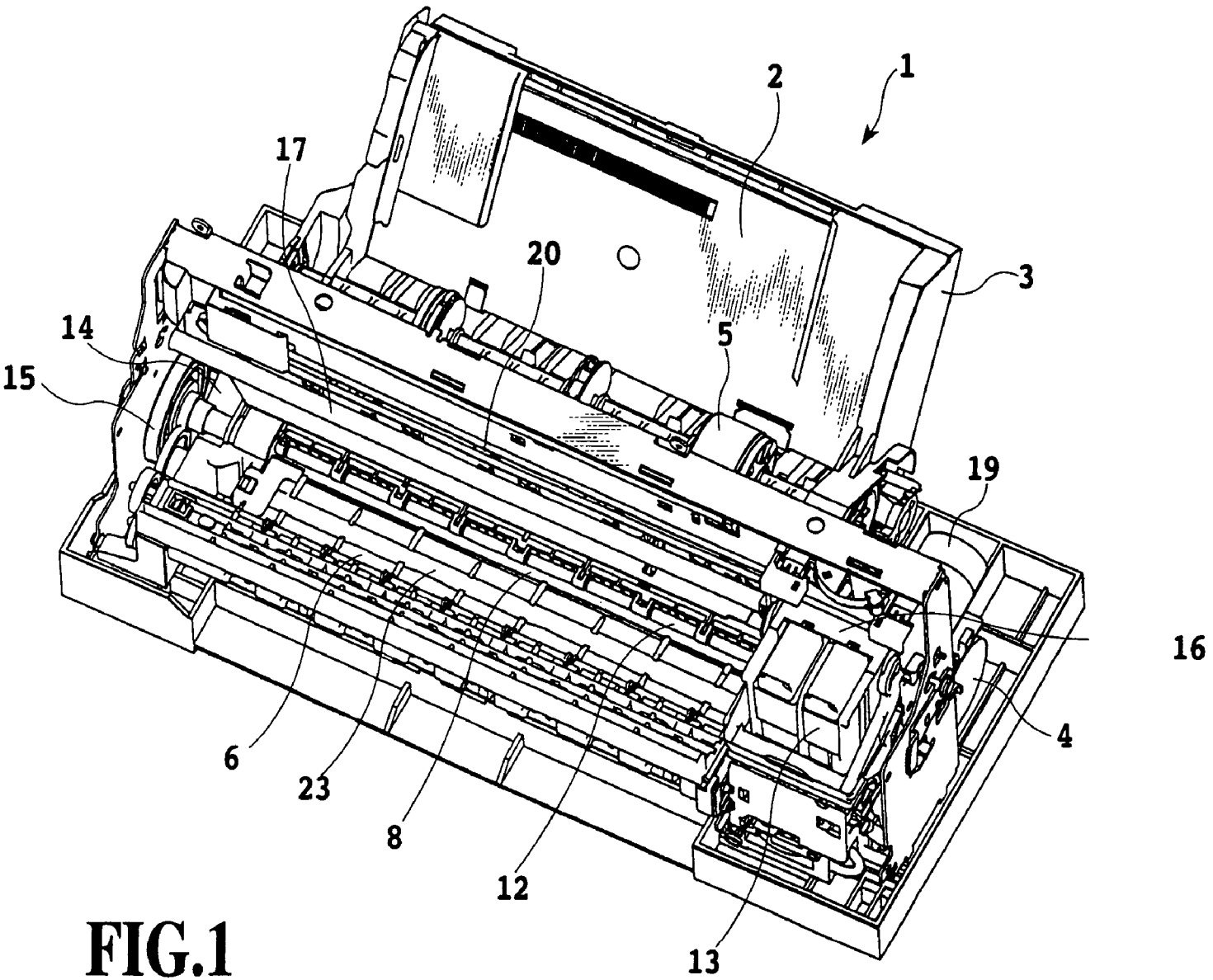
FIG. 1 is a perspective view showing the internal structure of an ink jet printing apparatus according to an embodiment of the present invention.

Description will be given below of an ink jet printing apparatus according to an embodiment of the present invention. The ink jet printing apparatus according to the present embodiment is applicable not only to output equipment in a computer but also to a printing section of a copier, a facsimile machine, or the like.

First, with reference to FIGS. 1 to 3 and other figures, a brief description will be given of the configuration of an ink jet printing apparatus according to this embodiment as well as a printing operation performed by the ink jet printing apparatus.

A pressure plate 2 of a sheet feeding device 1 has one end supported by a sheet feeding device frame member 3 for rotative movement. A bundle of sheets (print media) is stacked on the top surface of the pressure plate 2. To feed a sheet, a sheet feeding motor 4 as a driving source rotates a sheet feeding roller 5. The pressure plate 2 moves to the sheet feeding roller 5 owing to an urging force by a spring 7. A bundle of sheets is then sandwiched between the sheet feeding roller 5 and the pressure plate 2. Furthermore, the rotation of the sheet feeding roller 5 separates only the uppermost sheet from the bundle of sheets. The sheet is then fed downstream (step S1). The sheet feeding roller 5 further rotates to feed the sheet separated and fed by the sheet feeding device 1, to a sheet feeding roller 8 (step S1).

Then, the leading edge of the sheet separated and fed by the sheet feeding device 1 presses and rotates a sensor lever 9 arranged between the sheet feeding roller 5 and the conveying roller 8. Furthermore, the lead edge of the sheet is detected when the sensor lever 9 retreats from a detection position of the sheet sensor 10 (step S2).

Then, when the sheet sensor 10 detects the leading edge of the sheet, the sheet feeding roller 5 rotates to convey the sheet by a predetermined amount. Thus, the leading edge abuts against a nip portion formed by the conveying roller 8 and a pinch roller 12 urged by a spring in pressure contact with the conveying roller 8. The sheet is further conveyed by the sheet feeding roller 5 by a predetermined amount to bend its leading end portion. At this time, the leading edge of the sheet comes into pressure contact with the nip portion. Then, the operation of registering the sheet is finished.

After the registering operation, the conveying roller 8 and the pinch roller 12, which is in contact with the conveying roller 8, rotate to convey the sheet to the platen 6. The sheet is then supported by the top surface of the platen 6 opposite a surface of the print head 13 on which print elements are arranged (step S3). The center of the pinch roller 12 is offset downstream of the center of the conveying roller 8 to press the sheet against the top surface of the platen 6. The spacing (sheet distance) between the sheet supported by the platen 6 and the pint head is maintained. The conveying roller 8 is rotated via a conveying roller gear 15 by a stepping motor 14 that is a driving source.

Then, the print head 13, mounted on a carriage 16, prints the sheet supported on the top surface of the platen, by executing a main scan with the carriage while ejecting ink droplets (step S4). The carriage 16 is supported by a guide shaft 17 and a guide rail 18 for main scan. The carriage 16 is driven by a carriage motor 19 via a timing belt. To increase printing speed, the print head ejects ink during both forward scan and backward scan of the carriage 16, to achieve bidirectional printing.

During a printing operation, when the trailing edge of the sheet passes through the sensor lever 9, the sensor lever 9 returns to its initial position (detection position) The sensor lever 9 is then detected by the sheet sensor 10. Thus, the trailing edge of the sheet is detected (step S5).

Figure 6:
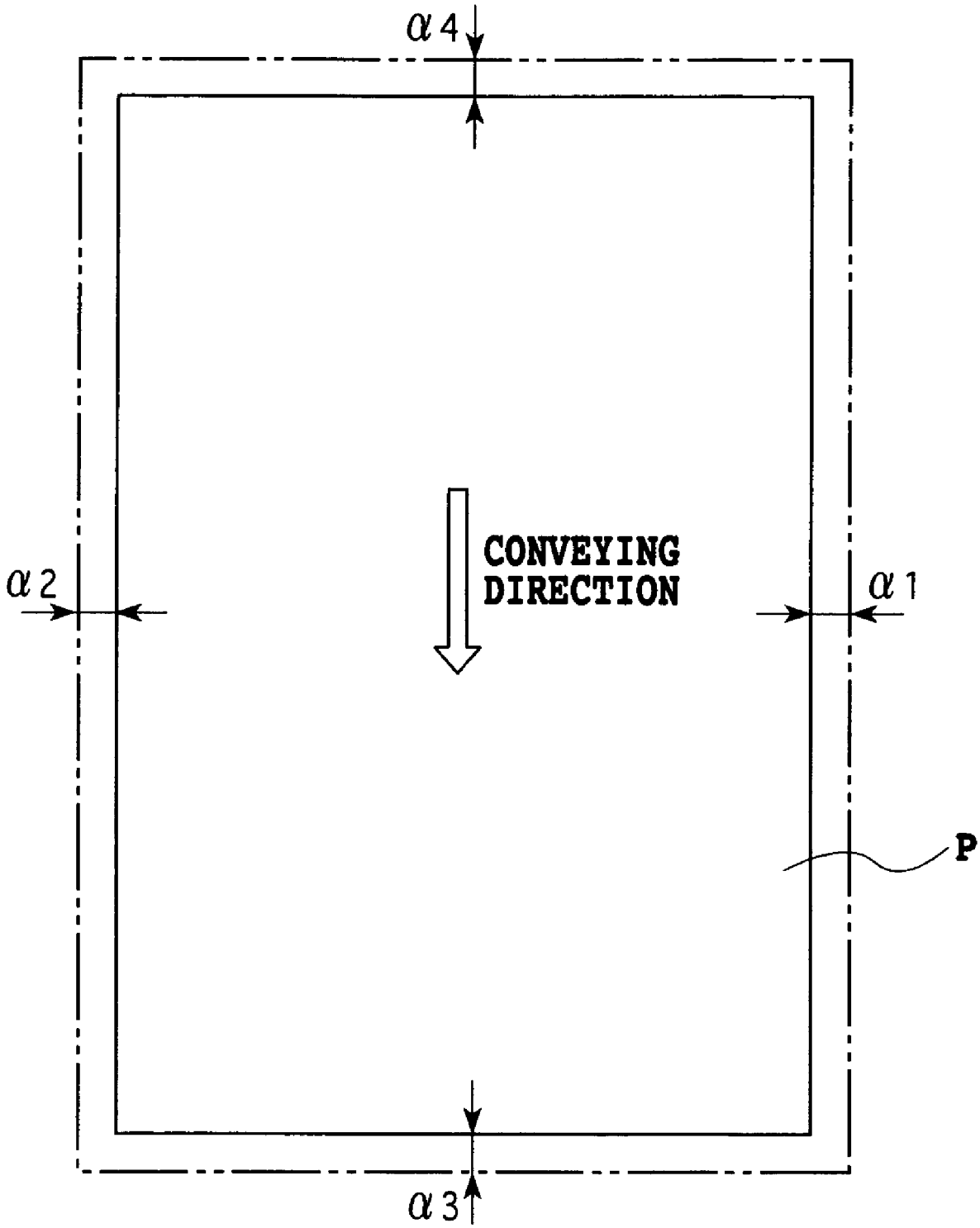
FIG. 6 is a plan view illustrating a print range obtained during marginless printing.

Now, it is assumed that what is called no-space printing is carried out in which the whole area of a print medium is printed without forming any space at the edges of the print medium. Then, as shown in FIG. 6, this printing is accomplished by printing an actual sheet P, shown by a solid line, so as to print an area bounded by a double-dashed chain line extending along and externally away from the sides of the sheet P by predetermined amounts $\alpha 1$ to $\alpha 4$, respectively. In this case, ink droplets ejected to positions outside the sheet P land on a platen ink absorbent 23 inserted into a concave portion in the platen 6 which is formed opposite the print element arranged surface of the print head 13.

The printed sheet is then sandwiched between a discharge roller 21 and a following spur 22 that is kept in pressure contact with the discharge roller 12 by a spur spring (not shown). These rollers rotate to discharge the sheet to the exterior of the apparatus (steps S9 and S10).

Now, detailed description will be given of determination of a registration values and application of the registration values to a printing operation.

Figure 7A:
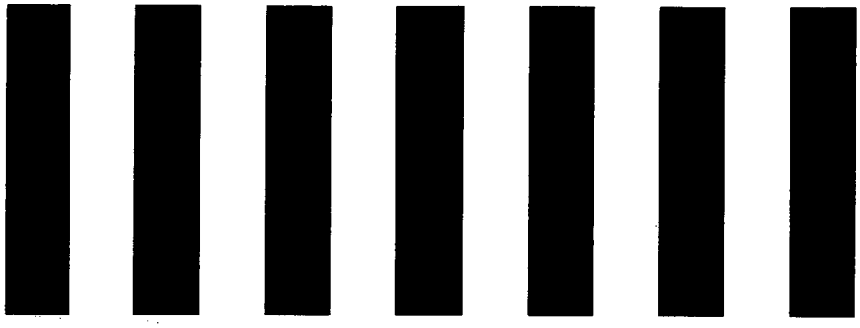
FIGS. 7A to 7C are views illustrating test patterns for registration.
Figure 7B:
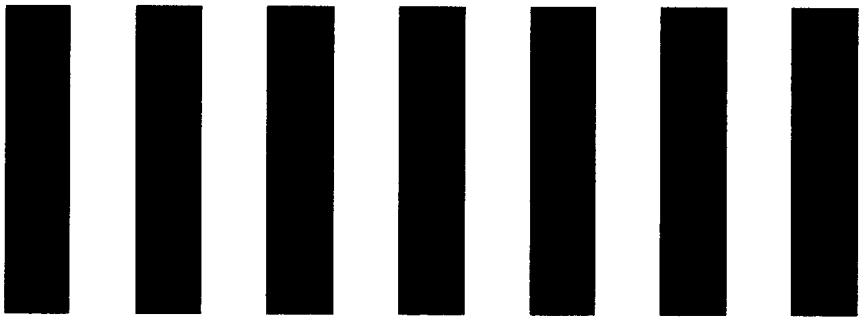
Figure 7C:
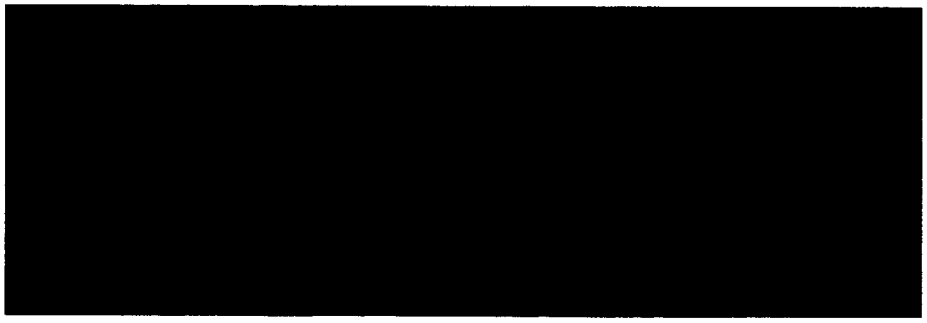
Figure 8A:
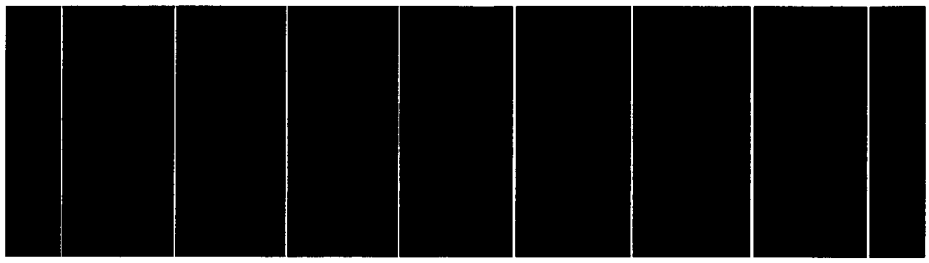
FIGS. 8A to 8E are views illustrating output results for test patterns for registration.
Figure 8B:
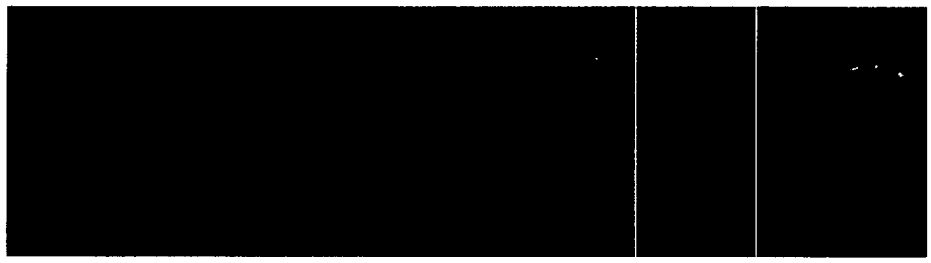
Figure 8C:
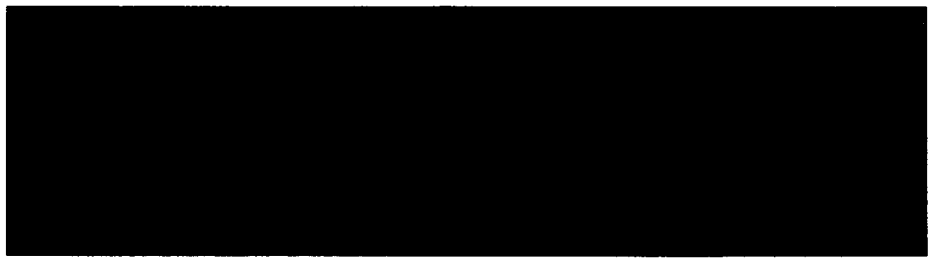
Figure 8D:
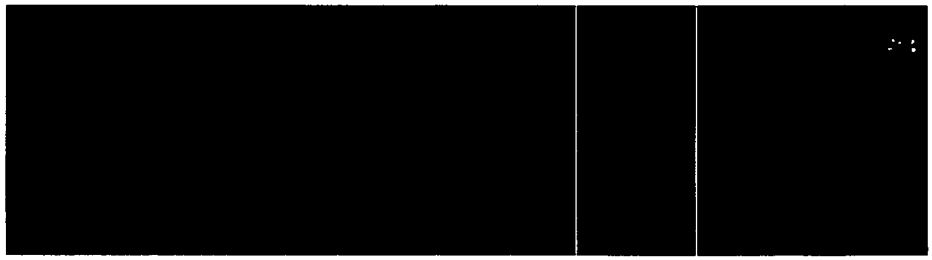
Figure 8E:
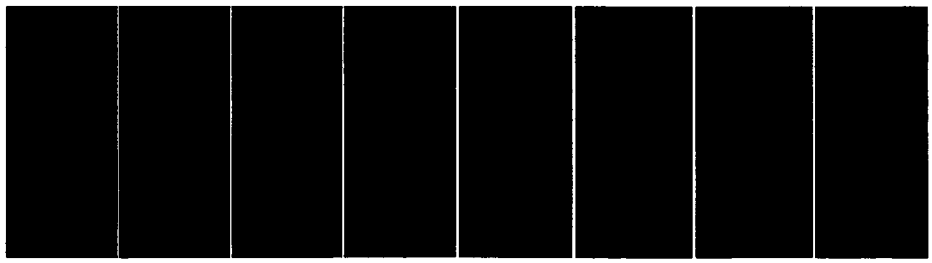
Figure 9:
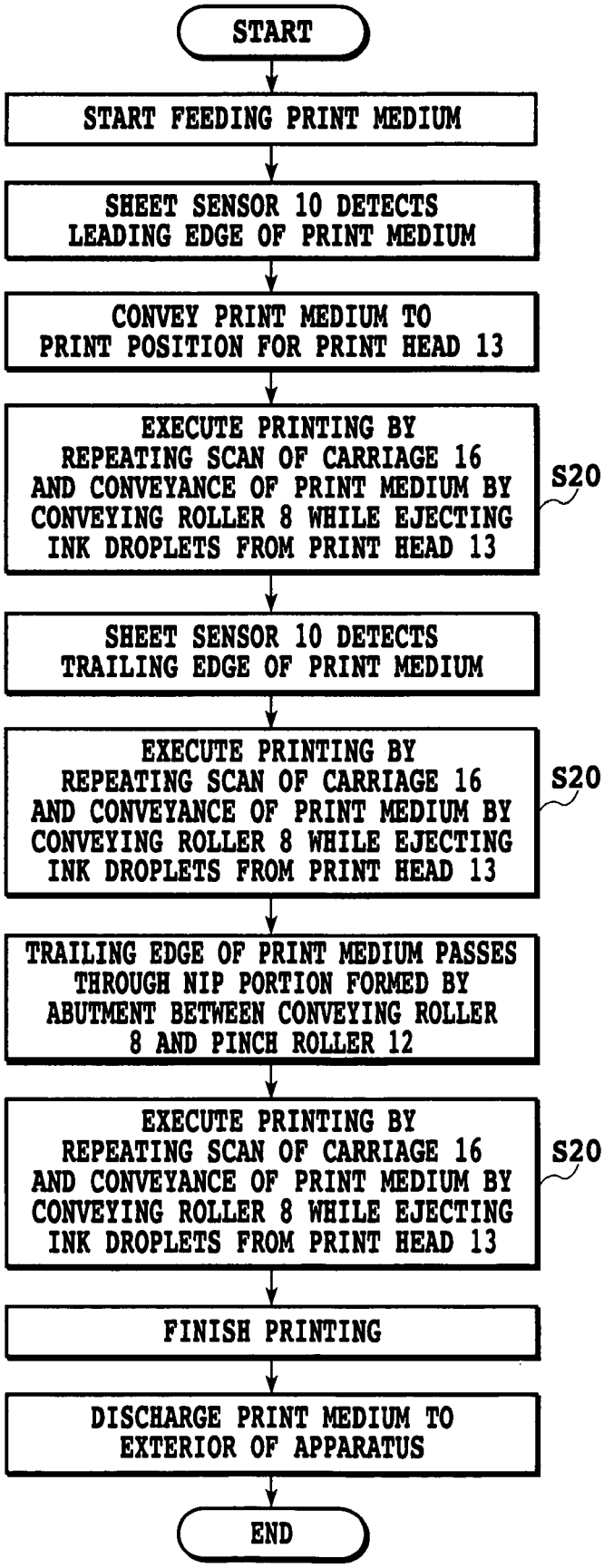
FIG. 9 is a flow chart of an operation of an ink jet printing apparatus, showing a conventional technique.

First, test patterns are formed in order to determine a reference registration value (first registration value). That is, the data to be printed shown in FIG. 7C is divided and the test pattern shown in FIG. 7A is printed during forward printing. The test pattern shown in FIG. 7B is printed during backward printing. In both cases, the patterns are formed in the same area. Then, the print medium is conveyed by a predetermined amount, and similar test patterns are printed in an area that has not been printed yet. This is process is repeated a number of times. However, timing for ink ejection is varied for each sheet conveyance. This provides output results such as those shown in FIGS. 8A to 8E. Then, one of these results, which is most similar to the test pattern shown in FIG. 7C, is selected. Specifically, the pattern shown in FIG. 8C is selected to determine a registration value for the smallest variation in ink droplet landing positions between forward printing and backward printing. One of the output results is normally selected visually by a user. However, the selection may be automated by using a scanner to read output results and inputting this data to the apparatus.

Figure 5:
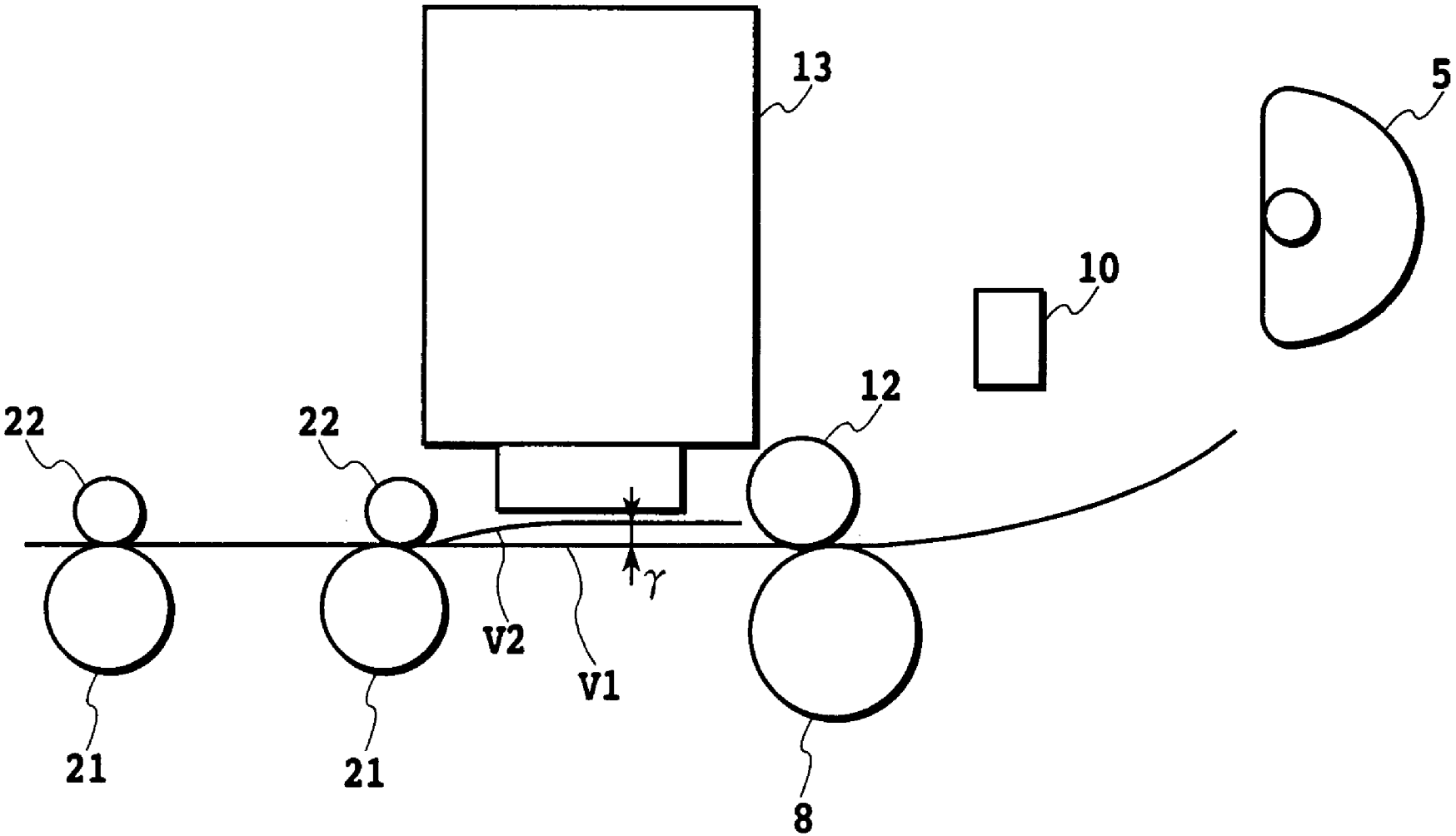
FIG. 5 is a side view illustrating a change in sheet distance resulting from the passage of the tailing edge of a sheet through a nip portion.

If test patterns are formed in order to determine the first registration value, the sheet P is sandwiched between the conveying roller 8 and the pinch roller 12 and the sheet is urged against the top surface of the platen 6. That is, the patterns determining the first registration value are formed with a fixed sheet distance (as shown at V1 in FIG. 5).

Before the trailing edge of the sheet passes through the nip portion formed by the abutment between the conveying roller 8 and the pinch roller 12, the sheet is printed using the first registration. This operation corresponds to steps S4 and S6 in the flow chart shown in FIG. 3 showing a printing operation from its start to end.

Then, after the trailing edge of the sheet P has passed through the nip portion between the conveying roller 8 and the pinch roller 12, a force that urges the sheet P against the top surface of the platen 6 decreases significantly. The sheet P thus floats upward as shown at V2 in FIG. 5 to reduce the sheet distance. Thus, the application of the first registration value, determined by the selection from the output results of the test patterns, results in variations in the landing positions of ink droplets between the forward and backward directions. Accordingly, a second registration value that prevents variations in the landing positions of ink droplets is precalculated on the basis of the first registration value, determined by registration, and the amount of change in sheet distance $\gamma$ (see FIG. 5), a which change is caused by the passage of the leading edge of the sheet through the nip portion Then, after the sheet has passed through the nip portion between the conveying roller 8 and the pinch roller 12, the sheet is printed by causing the print head to eject ink using a timing based on the second registration value. This operation corresponds to steps S7 and S8 in the flow chart shown in FIG. 3. The appropriate change amount $\gamma$ is experimentally obtained. The change amount $\gamma$ is preferably set independently for each sheet type. It can be determined on the basis of the detection of the sheet P by the sheet sensor 10 whether or not the trailing edge of the sheet has passed through the nip portion.

As described above, in the first embodiment, while the sheet is sandwiched at the nip portion, formed by the conveying roller 8 and the pinch roller 12, the first registration value is applied to adjust the ink ejection timing for printing in both forward and backward scanning directions. After the trailing edge of the sheet has passed through the nip portion between the conveying roller 8 and the pinch roller 12, the second registration value, obtained by correcting the first registration value on the basis of the amount of change in sheet distance, is applied to adjust the ink ejection timing for printing in both forward and backward scanning directions. Consequently, the appropriate landing positions can always be obtained. Therefore, high-grade printed images can be obtained all over the sheet.

With reference to the block diagram shown in FIG. 4, a brief description will be given of a control system applied to the embodiment of the present invention.

In this figure, reference numeral 100 denotes a control section that controls each driving section of the ink jet printing apparatus according to this embodiment. The control section 100 has a CPU 101 that executes processes such as various calculations, determinations, and control, a ROM 102 that stores programs executed by the CPU 101, and a RAM 103 temporarily storing inputted data and functioning as a work area for calculation processes executed by the CPU 101.

Furthermore, controlled sections are connected to the control device 100 and include a driving circuit 104 for the carriage motor 19, a driving circuit 105 for the stepping motor 14, which drives the conveying roller 8, a driving circuit 106 for the sheet feeding motor 4, and a head driving circuit 107 that drives print elements (heaters) provided in nozzles in the print head 13. Moreover, the control device 100 connects to an interface (I/F) 104 that transmits and receives signals to and from a host computer, an encoder 108 that detects the position of the carriage 16, the sheet sensor 10, and the like. On the basis of signals inputted by these sections, the CPU 101 of the control device 100 executes processes such as calculations, control, and determinations which relate to the previously described printing operation, registration, and the like. The first and second registration values are stored in the RAM 103.

Second Embodiment

Now, a second embodiment of the present invention will be described.

Figure 2:
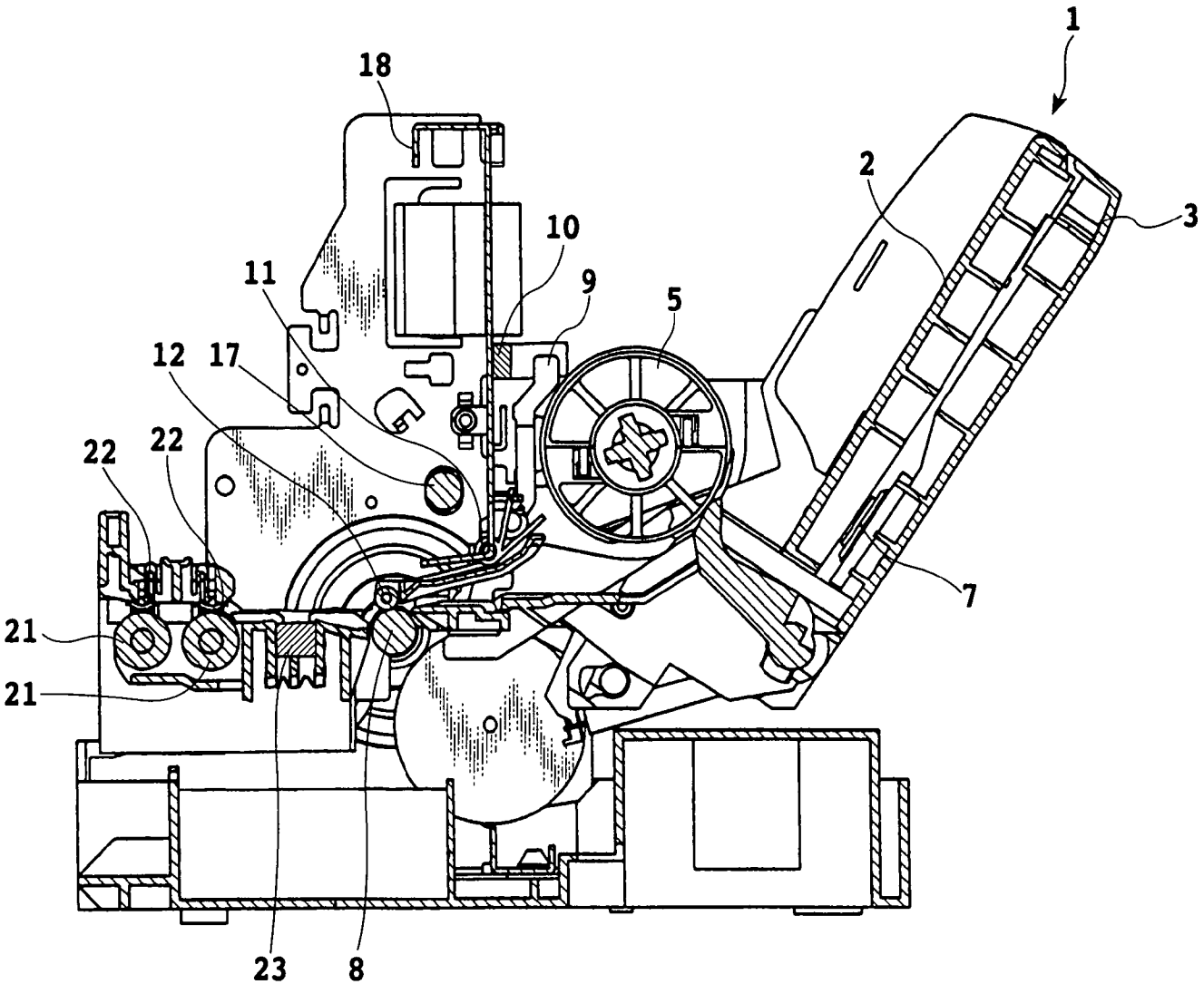
FIG. 2 is a side sectional view of the ink jet printing apparatus according to an embodiment of the present invention.
Figure 3:
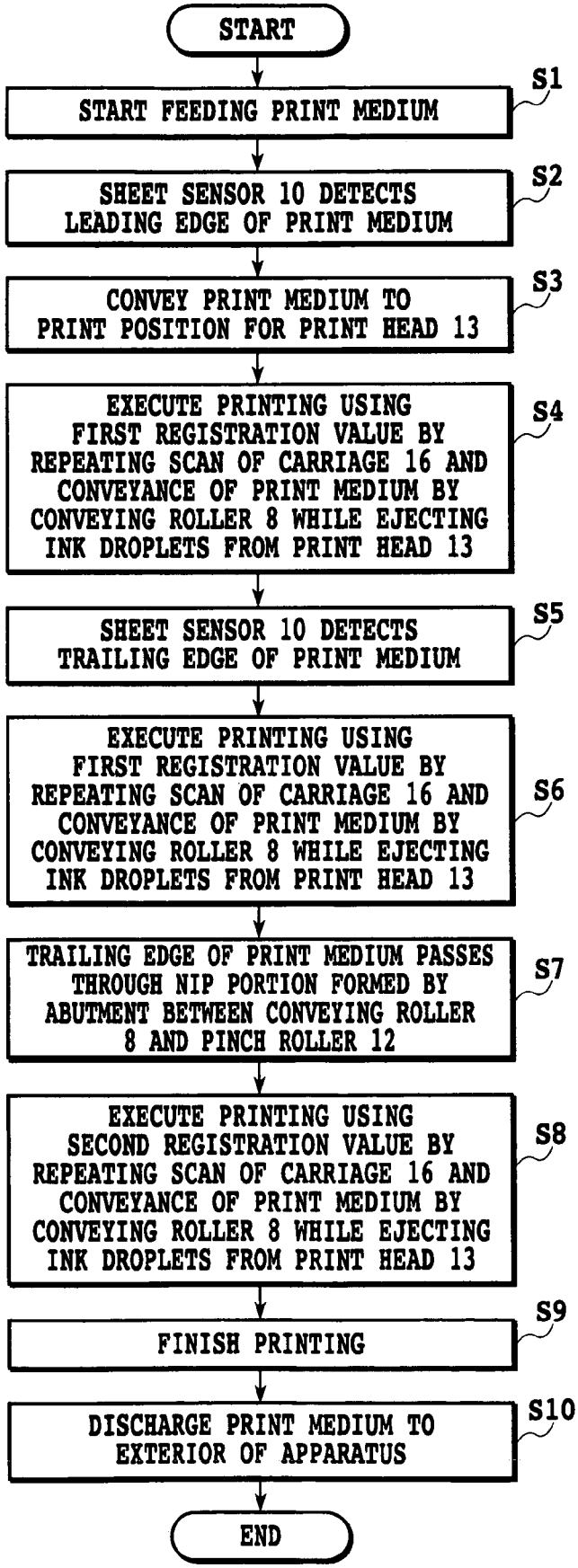
FIG. 3 is a flow chart showing a control operation performed by the ink jet printing apparatus according to an embodiment of the present invention.
Figure 4:
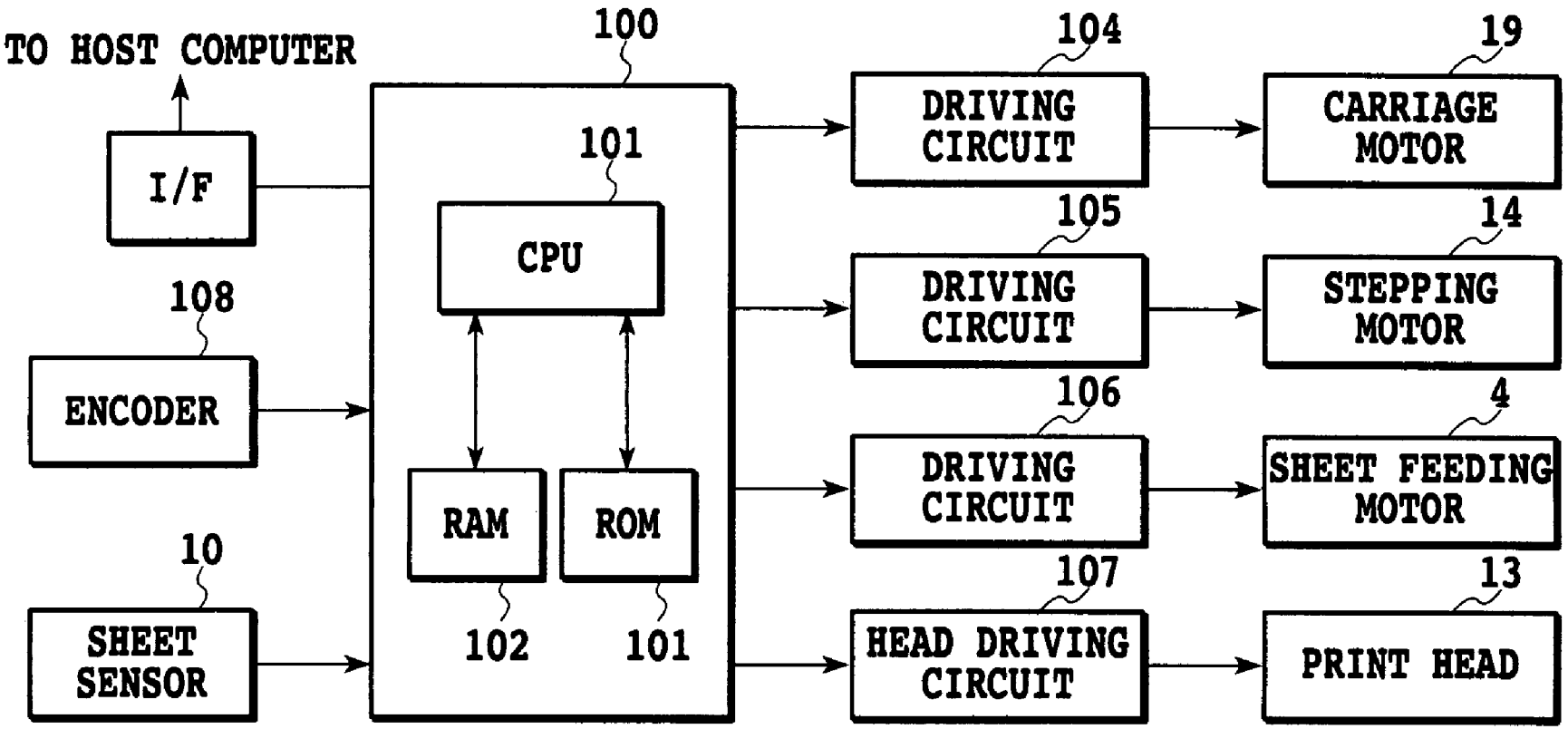
FIG. 4 is a block diagram schematically showing the configuration of a control system of the ink jet printing apparatus according to an embodiment of the present invention.

The second embodiment has a configuration substantially similar to that shown in FIGS. 1, 2, and 4, described in the first embodiment. In this embodiment, a non-contact type reflection sensor 110 is mounted on the carriage 16 to carry out registration while always measuring the amount of change in sheet distance. This differs from the first embodiment.

Specifically, in the second embodiment, the second registration value is calculated on the basis of the value of the sheet distance measured by the reflection sensor 110 every time the conveying roller 8 conveys the sheet P as well as the first registration value determined on the basis of patterns. Then, the second registration value is applied to printing, that is, the optimum second registration value is applied for each scan of the carriage 16. That is, in the second embodiment, the second registration value is changed to an optimum one for each scan of the carriage 16.

This avoids misregistration caused by a variation in sheet distance all over the sheet. Therefore, higher-grade printing can be carried out all over the sheet.

Third Embodiment

Now, description will be given of an ink jet printing apparatus according to a third embodiment of the present invention. The configuration of the whole apparatus is similar to that of the first embodiment.

In the third embodiment, test patterns for registration are printed before and after the trailing edge of a sheet passes through the nip portion between the conveying roller 8 and the pinch roller 12. Then, the first registration value is determined on the basis of the test patterns formed before the leading edge of the sheet passes through the nip portion. The second registration value is determined on the basis of the test patterns formed after the leading edge of the sheet has passed through the nip portion.

To perform an operation of forming an image, the sheet is printed using the first registration value before the trailing edge of the sheet passes through the nip portion. Then, the sheet is printed using the second registration value after the trailing edge of the sheet has passed through the nip portion. This avoids misregistration caused by a variation in sheet distance which occurs before or after the trailing edge of the sheet passes through the nip portion. Therefore, higher-grade printing can be carried out all over the sheet.

Fourth Embodiment

Now, a fourth embodiment of the present invention will be described. Also in this embodiment, the configuration of the whole apparatus is similar to that of the first embodiment.

As described in the previously described first embodiment, if a concave portion is formed in the platen so that an ink absorbent can be inserted into the concave portion, then the sheet distance may vary when the leading and trailing edges of the sheet enter the concave portion. In this case, the landing positions of ink droplets deviate and thus the registration value must be corrected.

Thus, in the fourth embodiment, the different registration values (first and second registration values) are applied to printing before and after the print medium passes between the conveying roller and the pinch roller. Furthermore, for the whole area of the sheet, registration values are predetermined for parts of the sheet expected to undergo a variation in sheet distance. Then, by using the registration values corresponding to the sheet distances in the respective parts of the sheet, it is possible to accomplish more appropriate registration. Therefore, higher-grade printing can be carried out all over the sheet.

Fifth Embodiment

With the ink jet printing apparatus, if high-density printing increases the amount of ink landing on a print medium per unit area, the print medium may be cockled. In this case, the sheet distance varies between actual image printing and the formation of test patterns for registration. Accordingly, if the registration values determined on the basis of the test patterns are directly used to perform a printing operation, the landing positions of ink droplets may deviate from the correct ones. Thus, in the fifth embodiment, the registration values are corrected in accordance with the printing density. This enables the optimum registration to be accomplished even during high-density printing. When the correction of the registration values based on the printing density is applied to the first, third, and fourth embodiments, the combination of this application with the functions of each embodiment enables higher-grade printing to be carried out all over the print medium.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus comprising print medium conveying means for conveying a print medium, scanning means for moving a print head, which ejects ink droplets, along a main scanning direction crossing a direction in which the print medium is conveyed, and printing control means for controlling an operation performed by the print head to eject droplets, wherein said print medium conveying means comprises at least a pair of rollers located upstream of an area printed by said print head, wherein said printing control means comprises:

first printing control means for allowing formation of test patterns used to adjust landing positions of ink droplets in the main scanning direction, the ink droplets ejected by the print head onto the print medium; and second printing control means for controlling the operation performed by said print head to eject ink droplets in the main scanning direction on the basis of landing position adjustment values for the ink droplets determined on the basis of said test patterns, and wherein before a trailing edge of the print medium passes through said conveying means, said second printing control means performs an ink ejecting operation on the basis of a first landing position adjustment value, and after a trailing edge of the print medium passes through said conveying means, on the basis of a second landing position adjustment value determined on the basis of the first landing position adjustment value and a correction value, the second landing position adjustment value being different from the first landing position adjustment value.

2. An ink jet printing apparatus comprising print medium conveying means for conveying a print medium, scanning means for moving a print head, which ejects ink droplets, along a main scanning direction crossing a direction in which the print medium is conveyed, and printing control means for controlling an operation performed by the print head to eject droplets, wherein said print medium conveying means comprises at least a pair of rollers located upstream of an area printed by the print head, wherein said printing control means comprises:

first printing control means for allowing formation of test patterns used to adjust landing positions of ink droplets in the main scanning direction, the ink droplets ejected by the print head onto the print medium; and second printing control means for controlling the operation performed by the print head to eject ink droplets in the main scanning direction on the basis of landing position adjustment values for the ink droplets determined on the basis of the test patterns, wherein said first printing control means allows to form a first test pattern before a trailing edge of the print medium passes through said print medium conveying means, and allows to form a second test pattern after the trailing edge of the print medium has passed through said pair of rollers, and wherein before the trailing edge of the print medium passes through said print medium conveying means, said second printing control means performs an ink ejecting operation on the basis of a first landing position adjustment value determined from the first test pattern, and after the trailing edge of the print medium has passed through said pair of rollers, said second printing control means performs an ink ejecting operation on the basis of a second landing position adjustment value determined from the second test pattern.

3. An ink jet printing apparatus according to claim 1 or 2, wherein the second landing position adjustment value varies depending on the type of the print medium.

* * * * *

UNITED STATES PATENT AND TRADEMARK OFFICE

CERTIFICATE OF CORRECTION

PATENT NO. : 7,284,814 B2
APPLICATION NO. : 10/782781
DATED : October 23, 2007
INVENTOR(S) : Ogasawara It is certified that error appears in the above-identified patent and that said Letters Patent is hereby corrected as shown below:

COLUMN 1:
Line 58, "hereinafter" should read --hereinafter be--.

COLUMN 2:
Line 11, "(misregistration)" should read --(misregistration).--.

COLUMN 3:
Line 31, "tailing" should read --trailing--.

COLUMN 4:
Line 8, "lead" should read --leading--.
Line 30, "pint" should read --print--.
Line 44, "position)" should read --position).--.

COLUMN 5:
Line 47, "a" should be deleted.
Line 49, "portion" should read --portion.--.

COLUMN 8:
Line 15, "said" should read --the--.
Line 25, "said" should read --the--.

Signed and Sealed this

Tenth Day of March, 2009

JOHN DOLL
*Acting Director of the United States Patent and Trademark Office*